US009021980B1

(12) United States Patent
Vasta et al.

(10) Patent No.: US 9,021,980 B1
(45) Date of Patent: May 5, 2015

(54) DOSAGE INDICATOR

(75) Inventors: Joseph Vasta, Ft. Lauderdale, FL (US); Neal Rosenblum, Hollywood, FL (US)

(73) Assignee: Joseph Vasta, Fort Lauderdale, FL (US)

( * ) Notice: Subject to any disclaimer, the term of this patent is extended or adjusted under 35 U.S.C. 154(b) by 314 days.

(21) Appl. No.: 13/158,877

(22) Filed: Jun. 13, 2011

Related U.S. Application Data

(60) Provisional application No. 61/418,916, filed on Dec. 2, 2010.

(51) Int. Cl.
*A61J 7/04* (2006.01)
*G09F 11/23* (2006.01)
*G05G 1/10* (2006.01)

(52) U.S. Cl.
CPC ... *A61J 7/04* (2013.01); *G05G 1/10* (2013.01); *G09F 11/23* (2013.01)

(58) Field of Classification Search
USPC ..... 116/306–309, 311–316, 318
See application file for complete search history.

(56) References Cited

U.S. PATENT DOCUMENTS 4,345,541 A * 8/1982 Villa-Real ..... 116/308
4,419,016 A 12/1983 Zoltan
4,501,370 A * 2/1985 Kelley ..... 215/219
5,011,032 A 4/1991 Rollman
5,014,798 A 5/1991 Glynn
5,358,117 A * 10/1994 Adams ..... 206/534
5,433,324 A 7/1995 Leonard
6,032,609 A 3/2000 Luoma
6,152,067 A 11/2000 Mathison
6,789,497 B1 * 9/2004 Aiken ..... 116/308
6,926,002 B2 8/2005 Scarrott et al.
6,938,796 B2 9/2005 Blacker et al.
7,017,762 B2 3/2006 Shane
7,100,530 B2 9/2006 Lu
2004/0173137 A1 * 9/2004 Carbajal ..... 116/311
2008/0128381 A1 * 6/2008 Ramoundos ..... 215/230

* cited by examiner

*Primary Examiner* — Laura Martin
*Assistant Examiner* — Irving A Campbell
(74) *Attorney, Agent, or Firm* — Hanrahan Law Firm, P.A.; Benjamin M. Hanrahan

(57) ABSTRACT

A dosage indicator assembly is presented which may be removably attached or fixedly attached to a pill bottle or other medication container, for instance, for disposition onto a top surface of a pill bottle cap, as a replacement cap for a pill bottle, or integral with a cap of a pill bottle. In particular, the dosage indicator assembly of the various embodiments of the present invention is cooperatively structured to track and/or indicate to a user the consumption of prescription pills or other medication in order to prevent inadvertent overdose, for instance, as a result of a lapse in memory as to whether a pill or medication has recently been consumed.

4 Claims, 5 Drawing Sheets

DOSAGE INDICATOR

CLAIM OF PRIORITY

The present application is based on and a claim of priority is made under 35 U.S.C. Section 119(e) to a provisional patent application that is in the U.S. Patent and Trademark Office, namely, that having Ser. No. 61/418,916 and a filing date of Dec. 2, 2010, the contents of which are incorporated herein by reference in its entirety.

BACKGROUND OF THE INVENTION

1. Field of the Invention

The present invention is generally directed to a pill or medication dosage indicator assembly which may be removably attached or fixedly attached to a pill bottle or other medication container, for instance, for disposition onto a top surface of a pill bottle cap, as a replacement cap for a pill bottle, or integral with a cap of a pill bottle. In particular, the pill and/or medication dosage indicator assembly of the various embodiments of the present invention is cooperatively structured to track and/or indicate to a user the consumption of prescription pills or other medication in order to prevent inadvertent overdose, for instance, as a result of a lapse in memory as to whether a pill or medication has recently been consumed.

2. Description of the Related Art

It is frequently difficult for people, especially elderly people, to accurately keep track of their compliance with prescribed and other medications. For example, many people have multiple medications to consume, oftentimes each one having different consumption requirements, e.g., once a day, twice a day, three times a day, twice a week, etc. Non-compliance with a medical prescription, whether under-dosing or over-dosing, can have serious health and other implications for the individual. Current options to assist with compliance with prescribed and other medications include weekly or monthly pill boxes or electronic reminder gadgets, both of which are cumbersome and inconvenient to use.

There is thus a need in the art for an accurate and easy device which affixes to or is part of the medication container and/or pill bottle in order to allow the user to track the consumption of medication. The user will thus be less likely to under-dose or over-dose on the medication, even in the event of a memory lapse as to whether the user has or has not consumed a particular dose of medication.

SUMMARY OF THE INVENTION

The present invention is generally directed to a dosage indicator which is removably attached, fixedly attached, and/or integral to a cap for a pill bottle or other medication container. For instance, the dosage indicator may be attached to the top of a pill bottle lid (via adhesion or other attachment). In other embodiments, the dosage indicator comprises an attachment mechanism that may replace an existing lid of a pill bottle, and in yet another embodiment, the dosage indicator may be integral with a lid and/or bottle where a user either purchases pills or other medication in the bottle comprising the dosage indicator, or transfers medication into a bottle comprising the dosage indicator.

As used herein, the terms "pill" or "medication" mean any solid, liquid, gaseous, gel, or other form of medicine, including but in no way limited to tablets, capsules, powder, drops, inhalants, sprays, suppositories, skin preparations, ointments, creams, lotions, etc. Accordingly, a "pill bottle" or "medication container" as used herein includes any container, bottle, box, tube, etc., used to store, deliver or hold medication.

Moreover, the dosage indicator of at least one embodiment comprises a dosage display panel, a day display panel and a pointer. The pointer is selectively movable into and out of a plurality of predetermined positions relative to the dosage display panel and is structured to selectively align with or point to one or more dosage indicia disposed on the dosage display panel.

In addition, the day display panel comprises a plurality of day indicia corresponding to each day of the week. In at least one embodiment, the day indicia may be selectively disposed or visible through a display window, opening and/or aperture where a user can set or select the day.

In operation of at least one embodiment of the present invention, a user may selectively position the pointer to align with a corresponding dosage number after the user has taken or consumed a dose of the corresponding medication. For exemplary purposes only, after taking a first dose of medication for the day, a user will align the pointer to point to the dosage indicia of number "1" on the dosage display panel. The user will then know that he or she has taken the first dose of the day. Similarly, after taking a second dose on the same day, the user will move the pointer to align with the number "2" on the dosage display panel. Again, this will inform the user that he or she has consumed the second dose for the day. The user can thus easily track his or her consumption of the medication throughout the day, and if the user's memory lapses as to whether he or she did or did not take a dose, the user can simply glance at the dosage indicator easily identify the answer.

The next day, the user can rotate the dosage display panel and/or the day display panel so as to alight the display window with the appropriate indicia relating to the next day. Again, the user will rotate the pointer to the appropriate location to indicate the dosage taken.

Of course, if desired, the user can use the pointer to indicate future doses, e.g., the next dose that must be taken, rather than past doses, e.g., a dose that was just taken. For instance, after the user takes a first dose for the day, the user may align the pointer to point at "2" to indicate that the next dose to take is dose number two.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
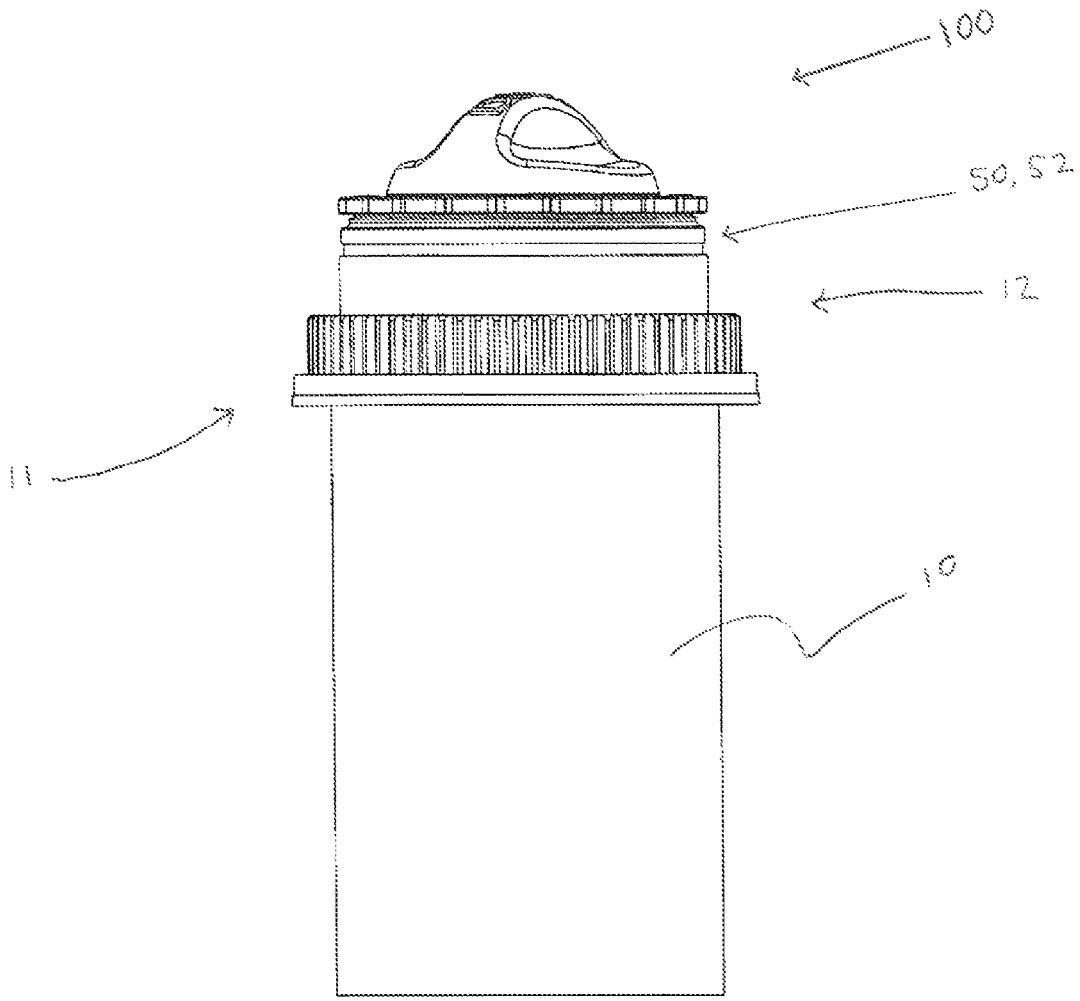
FIG. 1 is a front plan view of the dosage indicator of at least one embodiment of the present invention connected to a medication bottle.

As illustrated in the accompanying figures, the present invention is directed to a pill and/or medication dosage indicator assembly, generally referenced as 100. In particular, and as will become apparent from the following detailed description, the dosage indicator 100 of at least one embodiment of the present invention comprises an attachment mechanism 52 cooperatively structured to attach the dosage indicator 100 to a medication container 10, such as for example, a prescription pill bottle and/or any other bottle commonly used to hold or maintain one or more pills, medication, or the like. Moreover, in at least one embodiment, the dosage indicator 100 is attached to or otherwise disposed at an upper portion 11 of the container 10, including, for example, at a top or upper portion of a lid or cap 12 thereof.

Figure 2:
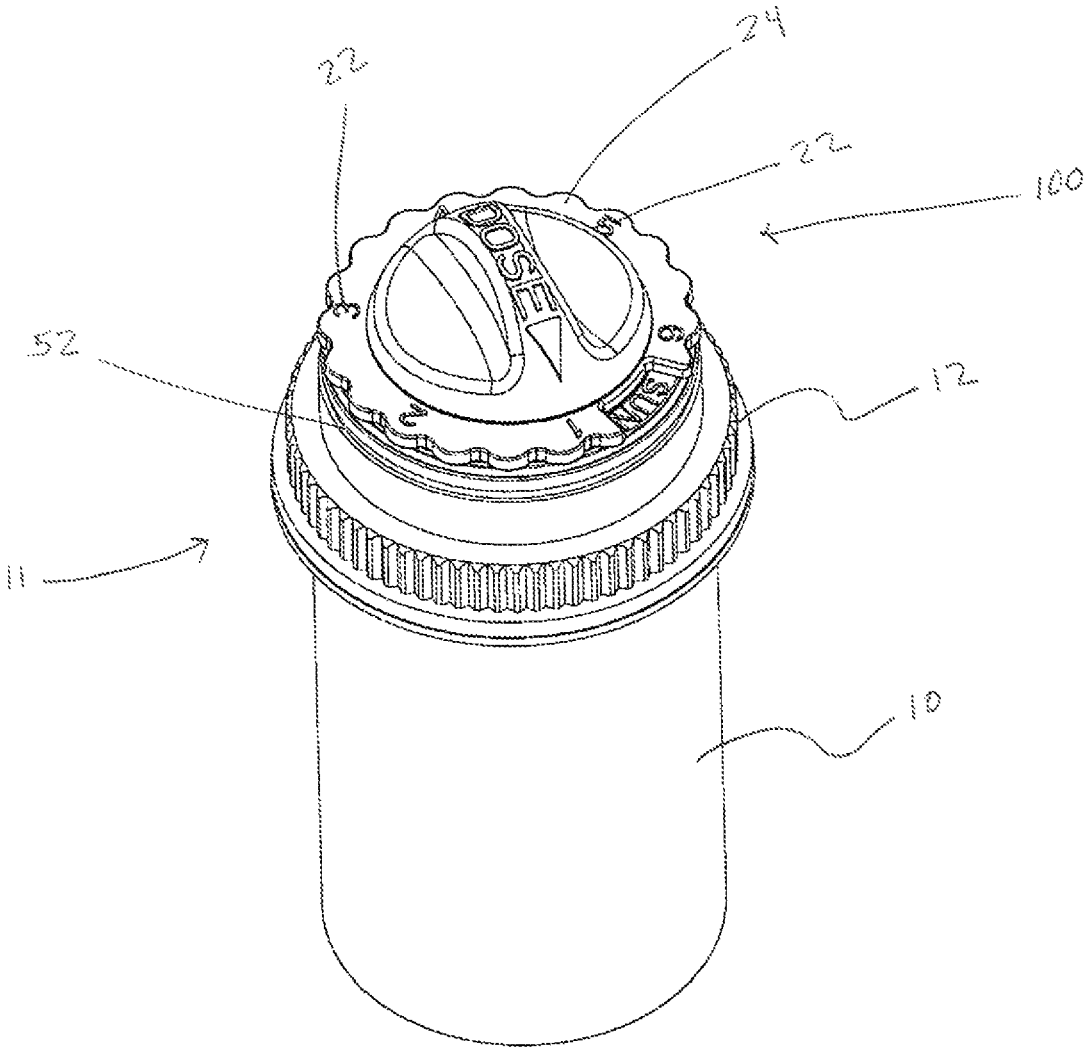
FIG. 2 is a top perspective view of the embodiment illustrated in FIG. 1.
Figure 3:
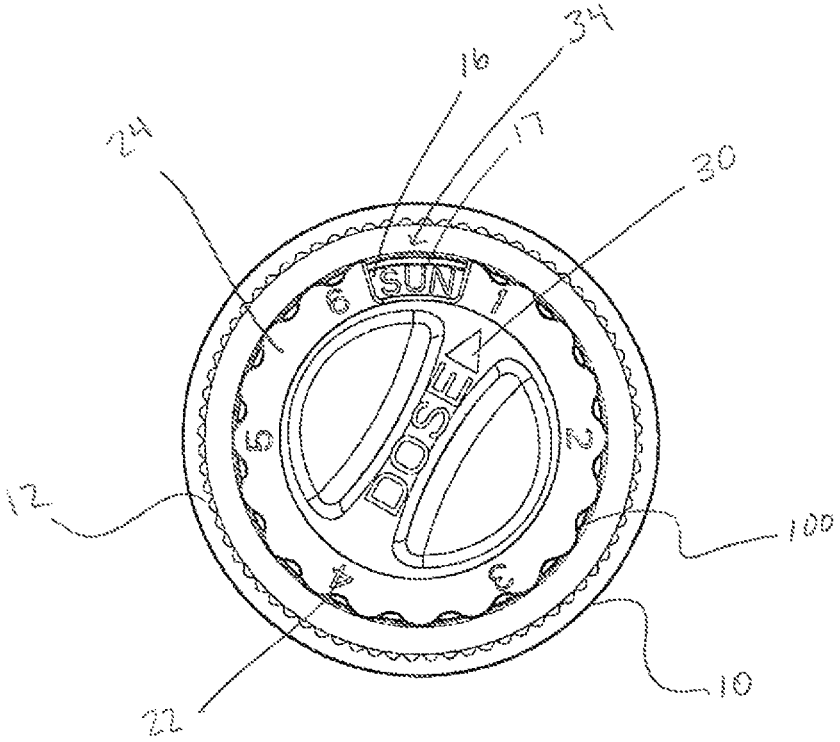
FIG. 3 is top view of the embodiment illustrated in FIGS. 1 and 2.
Figure 4A:
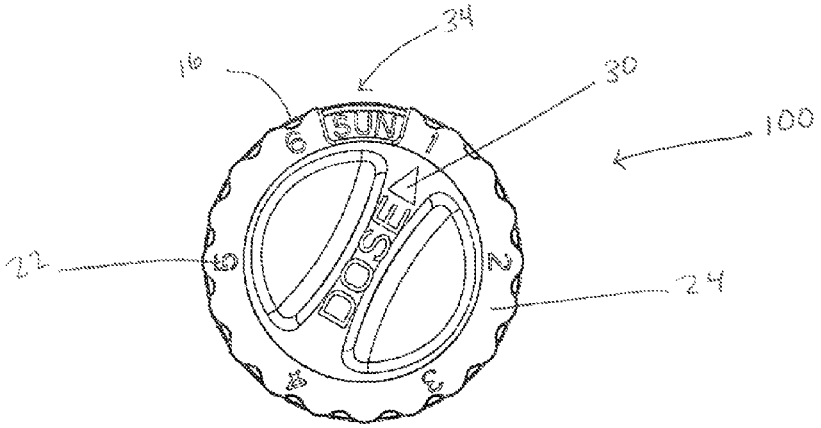
FIG. 4A is a top view of the dosage indicator as disclosed in accordance with at least one embodiment of the present invention.
Figure 4B:
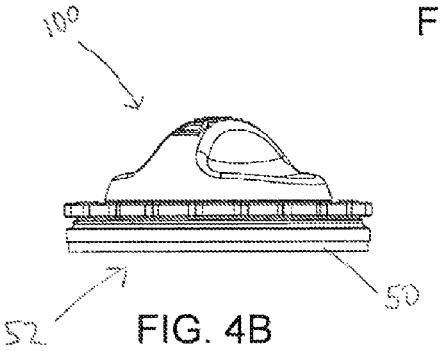
FIGS. 4B and 4C are side elevation views of the embodiment illustrated in FIG. 4A.
Figure 4C:
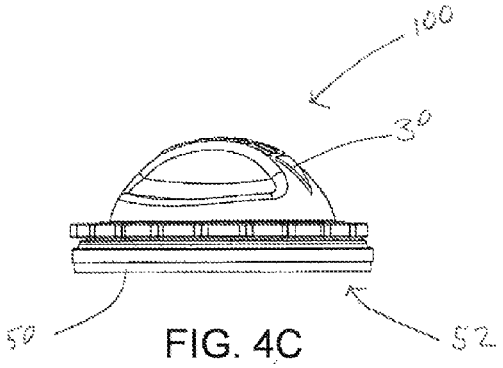
Figure 4D:
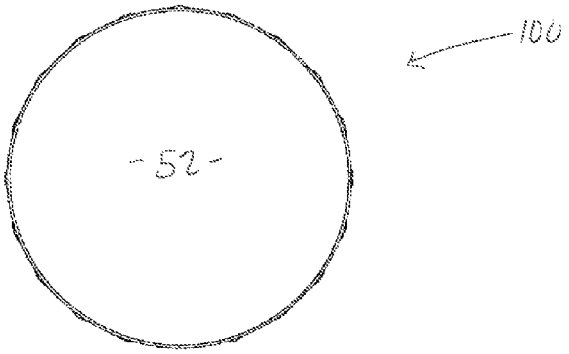
FIG. 4D is a bottom view of the embodiment illustrated in FIGS. 4A through 4C.

Specifically, in at least one embodiment, the attachment mechanism comprises an adhesive underlayer or component 50 which is cooperatively structured to adhere to or otherwise attach to the top surface or upper portion of the pill bottle lid 12, as illustrated in FIGS. 1 through 3. In such an embodiment, a user may peel off an adhesive covering or strip in order to expose the adhesive underlayer or surface 50. The dosage indicator 100 may then be adhered or connected to the top surface of the pill bottle cap 12.

Other attachment mechanisms 52 may be implemented, and thus the present invention is in no way limited to the adhesive underlayer 50 just described. In particular, the dosage indicator 100 of at least one embodiment may comprise a threaded, notched, mating, or engageable interior edge which is cooperatively structured to replace the existing pill bottle cap 12. Specifically, attachment mechanism 52 of the dosage indicator 100 may comprise a similar attachment structure as that incorporated into the exiting pill bottle 10 or cap 12. Accordingly, in order to attach the dosage indicator 100 of such an embodiment to the bottle 10, a user may remove the existing cap 12 and replace the cap 12 with the dosage indicator 100 of the present invention. In order to access the contents of the bottle 10, the user may remove the dosage indicator 100 in the same or similar manner in which the cap 12 was removed.

Of course, at least one embodiment of the present invention comprises a container 10 wherein the dosage indicator 100 is integrated into, fixedly attached to, or removably attached to the bottle cap 12 or other portion of the container 10. In such an embodiment, the user may remove the contents (e.g., pills or other medication) from the container(s) in which they were purchased, and place them into the bottle 10 containing the dosage indicator 100. It is contemplated, however, that the pills or medication may be purchased in a container 10 comprising a dosage indicator 100 of the present invention, and thus no transfer of medication is needed.

Referring now to FIGS. 2 and 3, the various embodiments of the present invention further comprise at least one dosage display panel 24 or ring comprising a plurality of dosage indicia 22 disposed thereon. In particular, the dosage indicia 22 generally correspond to a pill or medication dosage amount and comprise a number indicating a particular dosage amount that the user has taken, will take or needs to take, as will be described in greater detail below.

In addition, the dosage indicator 100 comprises a pointer 30 disposed in a selectively movable or positionable relation to the dosage display panel 24. For instance, the pointer 30 of at least one embodiment is rotationally positionable relative to the dosage display panel 24 and may thus selectively point to the dosage indicia 22 disposed thereon. A user may therefore turn or orient the pointer 30 to selectively point to a desired dosage indicia 22. In certain embodiments, and for one or more various reasons discussed below, the pointer 30 may also point to other various locations of the dosage display panel 24, for instance to areas disposed between the dosage indicia 22.

In the various embodiments of the present invention, the pointer 30 may be engaged into and out of one or more predetermined positions relative to the dosage display panel 24, such as via a pointer positioning assembly 60 described in greater detail below. For example, the various predetermined positions may coincide with the dosage indicia 22 such that the pointer 30 may "click" or be forcibly positioned into and out of the predetermined positions so as to selectively point to the dosage indicia 22. As mentioned above, the predetermined positions may also include positions between the dosage indicia 22 or other locations on the dosage display panel 24. The predetermined positions associated with the pointer 30 and/or dosage display panel 24 are structured to minimize or eliminate inadvertent movement of the pointer 30, such as, for example, if the dosage indicator 100 is in a user's pocket, purse or bag. Specifically, the pointer 30 is structured to move from one predetermined position to another, preferably adjacent predetermined position upon the exertion of a force by a user.

Furthermore, at least one embodiment of the dosage indicator 100 of the present invention comprises a day display panel 16 or disc. The day display panel 16 comprises a plurality of day indicia 17 disposed thereon. For example, the day indicia 17 corresponds to each day of the week, and thus may include, but is certainly not limited to, the following indicia or marks: "SUN," "MON," "TUE," "WED," "THU," "FRI," and "SAT." As shown in the accompanying drawings, the day display panel 16 of at least one embodiment is disposed under the dosage display panel 24. In particular the dosage display panel 24 may comprise a display window 34 cooperatively dimensioned and configured to display at least one of the various day indicia 17 therethrough.

Accordingly, in at least one embodiment, the dosage display panel 24 is disposed in a movable and/or rotational relation relative to the day display panel 16 in a manner such that at least one of the day indicia 17 is selectively displayed through the display window 34. It should also be noted that in other embodiments, the day display panel 16 is movable and/or rotationally disposed relative to the dosage display panel 24. Accordingly, regardless of whether one or both of the dosage display panel and/or the day display panel rotates or otherwise moves, the day indicia 17 is selectively displayed through the display window 34. In particular, the day display panel 16 and/or the dosage display panel 24 may be selectively positionable into and out of one or more predetermined positions by virtue of a display window positioning assembly 70, which in turn is structured to selectively display one or more day indicia 17 through the display window 34.

Accordingly, in one embodiment, the day display panel 16 is stationary in that it does not move rotationally, whereas the dosage display panel 24 is rotational or movable via the display window positioning assembly 70 in a manner such that a user can selectively change the day indicia 17 disposed through the display window 34. For example, dosage display panel 24 may be positionable into and out of a plurality of predetermined positions which coincide with the day indicia 17 such that the dosage display panel 24 may "click" or otherwise be forcibly positioned into and out of the predetermined positions. Of course, the predetermined positions may also include positions between the day indicia 17. The predetermined positions associated with the dosage display panel of such an embodiment are structured to minimize or eliminate inadvertent movement of the dosage display panel 24, such as, for example, if the dosage indicator 100 is in a user's pocket, purse or bag. Specifically, the dosage display panel 24 and the corresponding positioning assembly are cooperatively structured such that the dosage display panel 24 may move from one predetermined position to another predetermined position upon exertion of a force by a user.

In another embodiment, the dosage display panel 24 is stationary relative to the day display panel 16 in that the dosage display panel 24 of such an embodiment does not move rotationally or otherwise, whereas the day display panel 16 is rotational or movable via the display window positioning assembly in a manner such that a user can selectively change the day indicia 17 disposed through the display window 34. For example, day display panel 16 may be positionable into and out of a plurality of predetermined positions which coincide with the day indicia 17 such that the day display panel 16 may "click" or otherwise be forcibly positioned into and out of the predetermined positions. Of course, the predetermined positions may also include positions between the day indicia 17. The predetermined positions associated with the day display panel 16 of such an embodiment are structured to minimize or eliminate inadvertent movement of the dosage display panel 24, such as, for example, if the dosage indicator 100 is in a user's pocket, purse or bag. Specifically, the day display panel 16 and the corresponding positioning assembly are cooperatively structured such that the day display panel 16 may selectively move from one predetermined position to another predetermined position upon exertion of a force by a user.

Figure 5:
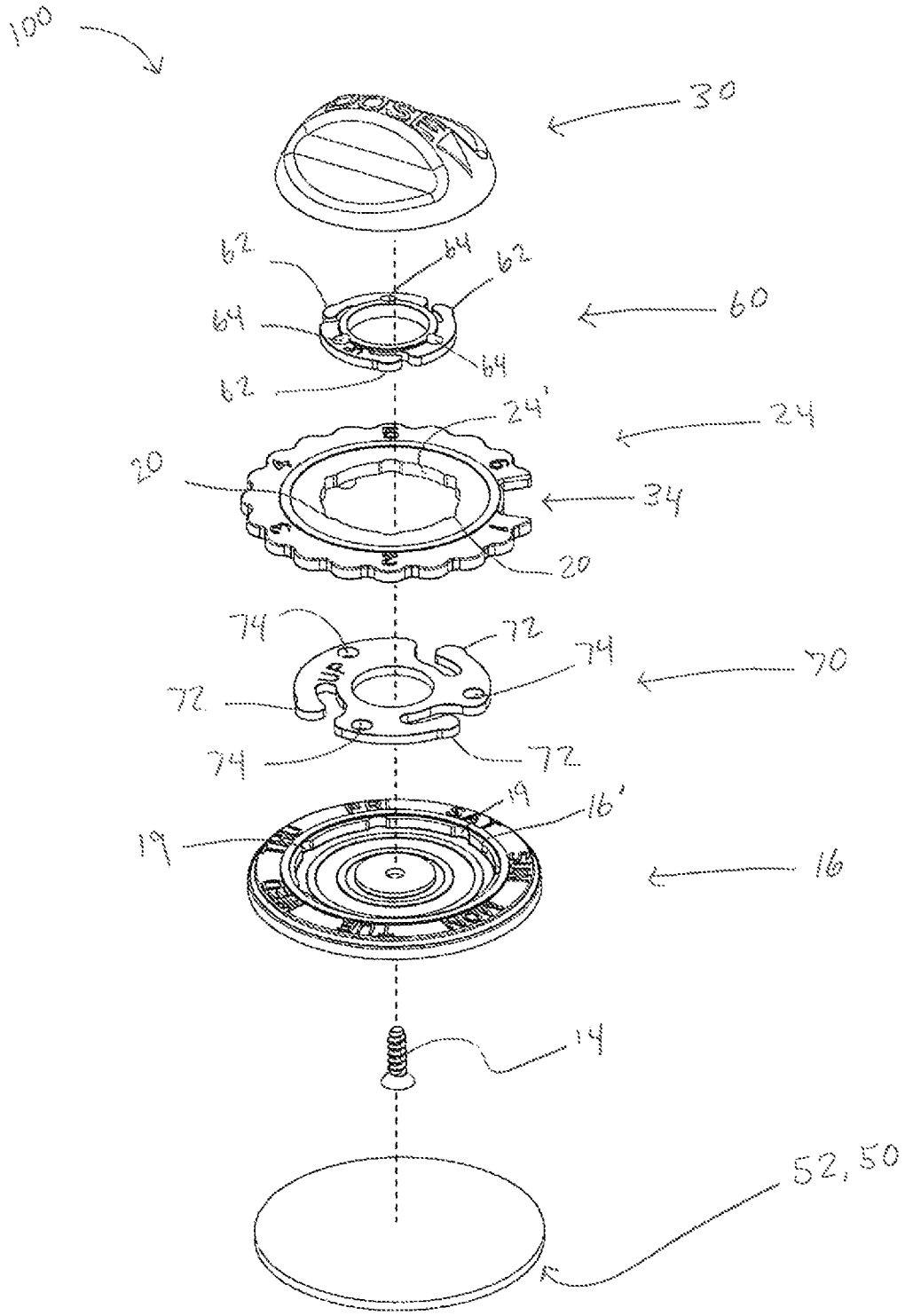
FIG. 5 is an exploded view of the dosage indicator as described in accordance with yet another embodiment of the present invention.

Referring now to the exploded view of FIG. 5, the dosage display panel or ring 24 of at least one embodiment of the present invention comprises a plurality of detents 20 circumferentially disposed on an interior edge 24' thereof. Furthermore, the pointer 30 is connected to a pointer positioning assembly, generally referenced as 60. In particular, the pointer positioning assembly 60 comprises at least one finger and/or cantilever 62 disposable in an engaging relation with at least one detent 20. Specifically, the finger(s) 62 and the detent(s) 20 are correspondingly positioned in a manner such that when engaged with one another, the pointer 30 is disposed in a predetermined, selectable position. As described above, the predetermined position(s) may be in an aligned relation with one or more dosage indicia 22 disposed on the dosage display panel or ring 24 and/or between adjacent dosage indicia 22.

In at least one embodiment, the pointer positioning assembly 60 comprises a plurality of fingers or cantilevers 62 disposed in an engaged relation with a plurality of correspondingly positioned detents 20 so as to align the pointer 30 into a selected predetermined position. Accordingly, the load or force is distributed among the plurality of fingers or cantilevers 62 in order to balance out the "clicking" or engagement of the fingers 62 with corresponding detents 20 and thereby reduce the friction between the parts. The plurality of cantilevers 62 equalizes the force on the center attachment screw 14 or other coupling device and creates a smooth but strong engagement. Again, the engagement is strong enough to minimize or eliminate inadvertent movement of the pointer 30, while still allowing a user to easily selectively position the pointer 30 into the desired position.

Furthermore, the positioning assembly 60 may be connected to the pointer 30 in any number of manners. Still referring to FIG. 5, in at least one embodiment, the positioning assembly 60 comprises one or more holes 64, detents, or ridges which engage or otherwise connect to corresponding pegs, notches, etc. (not shown) disposed on an undersurface of the pointer 30.

In addition, the day display panel or disc 16 of at least one embodiment comprises a plurality detents 19 disposed on an interior edge 16' thereof. Moreover, as illustrated in FIG. 5, the dosage indicator 100 of at least one embodiment comprises a display window positioning assembly 70 which is cooperatively structured to selectively position the dosage display panel 24 and/or the day display panel 16 into and out of one or more predetermined positions operatively displaying day indicia through the display window 34. In the embodiment shown, the display window positioning assembly 70 is secured or otherwise attached to the dosage display panel 24 via correspondingly positioned holes 74, detents, ridges, pegs notches etc. such that the dosage display panel 24 can be selectively positionable relative to a stationary day display panel 16.

Particularly, the positioning assembly 70 comprises at least one finger and/or cantilever 72 disposable in an engaging relation with at one corresponding detent 19. Specifically, the finger(s) or cantilever(s) 72 and the detent(s) 19 are correspondingly positioned in a manner such that when engaged with one another, the dosage display panel or ring 24 is disposed into a predetermined, selectable position. As described above, the predetermined position(s) may be defined wherein the display window 34 is disposed in an aligned relation with one or more day indicia 17 and/or between adjacent day indicia 17. In at least one embodiment, the positioning assembly 70 comprises a plurality of fingers or cantilevers 72 disposed in an engaged relation with a plurality of correspondingly positioned detents 19 so as to align the dosage display panel 24 into a selected predetermined position. Accordingly, similar to the pointer positioning assembly 60 described above, the load or force is distributed among the plurality of fingers or cantilevers 72 in order to balance out the "clicking" or engagement of the fingers 72 with corresponding detents 19 and thereby reduce the friction between the parts. The plurality of cantilevers 72 equalizes the force on the center attachment screw 14 or other coupling device and creates a smooth but strong engagement. Again, the engagement is strong enough to minimize or eliminate inadvertent movement of the dosage display panel 24, while still allowing a user to easily selectively position the dosage display panel 24 into the desired position.

Still referring to FIG. 5, each of the various components may be connected to one another, as indicated by the dashed line, via screw 14 or other coupling device, axle, etc. The base plate or attachment assembly 52 may comprise an upper portion 54 which connects to an under surface of the day display panel 16. In at least one embodiment, the upper surface of the base or attachment mechanism 52 comprises an adhesive layer or component such that the upper portion 54 is adhered to the day display panel 16. Of course, other attachment mechanisms or devices may be employed which are structured to facilitate the practice of the present invention in the intended manner.

In operation of at least one embodiment of the present invention, a user may move the pointer 30 to align with a corresponding dosage indicia 22 subsequent to taking or consuming a dose of the corresponding medication. For exemplary purposes only, after taking the first of three doses of medication for the day on Monday, a user will align the pointer 30 to point to the dosage indicia of number "1" on the dosage display panel 24. The user will then know that he or she has taken the first dose of the day.

Similarly, after taking the second of three doses on Monday, the user will move the pointer 30 to align with the number "2" on the dosage display panel 24. Again, this will inform the user that he or she has consumed the second dose for the day. Finally, after consuming the third of three doses for Monday, the user will rotate or align the pointer 30 with the number "3" on the dosage display panel 24. This will allow the user to easy track his or her consumption of the medication throughout the day, and if the user's memory lapses as to whether he or she did or did not take a dose, the user can simply glance at the dosage indicator 100 of the present invention and easily identify the answer.

The next day, the user can rotate the dosage display panel 24 and/or the day display panel 16 so as to alight the display window 34 with the indicia 17 relating to the next day, in this example, "TUE." Again, the user will rotate the pointer 30 to the appropriate location to indicate the dosage taken.

In certain application, the user can use the pointer 30 to indicate the next dose that must be taken, rather the dose that was taken (as in the example above). For instance, after the user takes dose one of three for the day, the user may align the pointer 30 to point at "2" to indicate that the next dose to take is dose number two.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A dosage indicator, comprising:

a rotational dosage display ring comprising a plurality of dosage indicia disposed on an upper surface thereof, said dosage indicia corresponding to a medication dosage, said dosage display ring comprising a plurality of detents circumferentially disposed on an interior edge thereof, a rotational pointer connected to a pointer positioning assembly and cooperatively disposed in a selectively movable relation to said dosage display ring, said rotational pointer being structured to selectively point to said dosage indicia, said pointer positioning assembly comprising a substantially flat, disc shape and being fixedly secured to an undersurface of said rotational pointer, said substantially flat, disc shaped pointer positioning assembly comprising a plurality of laterally disposed fingers each at least partially inwardly bendable for selective disposition into and out of an engaging relation with said detents circumferentially disposed on said interior edge of said dosage display ring, a stationary day display ring disposed under said rotational dosage display ring and comprising a plurality of day indicia disposed thereon, said day display ring comprising a plurality of detents disposed on an interior edge thereof, said rotational dosage display ring connected to a display window positioning assembly for rotational disposition of said rotational dosage display ring relative to said stationary day display ring, and said display window positioning assembly comprising a substantially flat, disc shape and being fixedly secured to an undersurface of said rotational dosage display ring, said substantially flat, disc shaped display window positioning assembly comprising a plurality of laterally disposed fingers each at least partially inwardly bendable for selective disposition into and out of an engaging relation with said detents circumferentially disposed on said interior edge of said stationary day display ring.

2. The dosage indicator as recited in claim 1 further comprising an attachment mechanism cooperatively structured to attach said dosage indicator to an upper portion of a prescription pill bottle.

3. The dosage indicator as recited in claim 2 wherein said plurality of fingers of said display window positioning assembly and said corresponding detents of said stationary day display ring are correspondingly disposed to position a display window into an aligned relation with said day indicia.

4. The dosage indicator as recited in claim 2 wherein said pointer and said dosage display ring are selectively and manually rotatable while said dosage indicator is disposed in an attached relation with the prescription pill bottle.

* * * * *